US009889553B2

(12) United States Patent
Ursell et al.

(10) Patent No.: US 9,889,553 B2
(45) Date of Patent: Feb. 13, 2018

(54) COLLAPSIBLE MOBILE WORK BENCH AND TOOL SUPPORT STAND

(71) Applicant: Affinity Tool Works, LLC, Troy, MI (US)

(72) Inventors: Mike Ursell, Bloomfield Hills, MI (US); Connor Ursell, Bloomfield Hills, MI (US); Mark Cross, Marysville, MI (US); Sam Ursell, Beverly Hills, MI (US); Ken Neilson, Troy, MI (US)

(73) Assignee: Affinity Tool Works, LLC, Troy, MI (US)

( * ) Notice: Subject to any disclaimer, the term of this patent is extended or adjusted under 35 U.S.C. 154(b) by 66 days.

(21) Appl. No.: 15/015,310

(22) Filed: Feb. 4, 2016

(65) Prior Publication Data

US 2016/0354920 A1 Dec. 8, 2016

Related U.S. Application Data

(60) Provisional application No. 62/111,747, filed on Feb. 4, 2015.

(51) Int. Cl.

| | |
|---|---|
| ***B25H 1/04*** | (2006.01) |
| ***B25H 1/16*** | (2006.01) |
| ***A47B 3/02*** | (2006.01) |
| ***A47B 9/16*** | (2006.01) |

(52) U.S. Cl.

CPC ..... *B25H 1/04* (2013.01); *A47B 3/02* (2013.01); *A47B 9/16* (2013.01); *B25H 1/16* (2013.01); *A47B 2003/025* (2013.01)

(58) Field of Classification Search

CPC .... B25H 1/04; B25H 1/16; A47B 3/02; A47B 9/16; A47B 2003/025

See application file for complete search history.

(56) References Cited

U.S. PATENT DOCUMENTS

| | | | | |
|---|---|---|---|---|
| 9,289,058 | B2 * | 3/2016 | Flaherty | A47B 9/16 |
| 2008/0115701 | A1 * | 5/2008 | Sugiura | B25H 1/16 108/132 |
| 2010/0242174 | A1 * | 9/2010 | Morrison, Sr. | A61B 90/60 5/507.1 |

FOREIGN PATENT DOCUMENTS

| | | | | |
|---|---|---|---|---|
| DE | 202011106462 | U1 * | 1/2012 | A47B 3/087 |

* cited by examiner

*Primary Examiner* — Jeanette E Chapman

(74) *Attorney, Agent, or Firm* — William H. Honaker; Dickinson Wright PLLC

(57) ABSTRACT

A collapsible mobile bench has a work surface that has opposed ends and a middle section. The opposed ends are wider than the middle section. The middle section is adapted to receive a tool. The work surface is adjustable between collapsed and raised positions, with the work surface being positionable at infinite positions between the collapsed and raised positions. A set of wheels are mounted to the work surface for transportation of the work bench. The work surface can be used as a work bench or a tool support and collapsed for transport and raised to a desired height for use.

28 Claims, 4 Drawing Sheets

COLLAPSIBLE MOBILE WORK BENCH AND TOOL SUPPORT STAND

CROSS REFERENCE TO RELATED APPLICATION

This application claims the benefit of U.S. Provisional Application No. 62/111,747 filed Feb. 4, 2015, which is incorporated herein by reference in its entirety.

BACKGROUND OF THE INVENTION

The present invention generally relates to a work bench which can also function as a tool support stand. Work benches and tool support stands are well known but typically separate articles. Work benches come in many shapes and sizes but generally do not easily support most power tools that are intended to be mounted. Workbenches tend to have a large wide flat surface upon with a user can work on a project. They can have fixed or adjustable legs and may be stationary or transportable. By contrast, tool support stands generally employ a top surface which is generally very narrow to which a tool, such as a saw, can be mounted and legs to support the stand. These tool support stands come in any number of sizes and shapes, but typically have four legs that are fixed in the support position or can be individually folded or telescoped to a closed position. Some of these known tool support stands also include extendable work surfaces that can be pulled out to make the overall length of the tool stand longer.

Examples of applicant's tool support stands can be found in U.S. Design Pat. Nos. D623,672 and D549,749.

The difficulty with typical tool support stands is that they can be large and unwieldy. If the legs are fixed in place, it can be difficult to move the tool stand from job to job. This is true even if wheels are provided to roll the tool stand. Folding legs and extendible legs can be cumbersome. Each leg has to be extended or folded out to use the stand and collapsed to transport the stand. Additionally, the tool support stands do not make ideal work benches, the tool support stands are too narrow to truly function as a good work bench.

What is needed is a versatile multipurpose tool stand and work bench that can be easily and quickly deployed, but is also easily transportable.

SUMMARY OF THE INVENTION

The present invention relates to work benches and tool support benches generally. In particular, the present invention relates to a collapsible mobile work bench and tool support stand unit. The unit is easily opened for use at any desired height and easily collapsible for storage or transportation. The unit has a set of wheels and handles to make transportation easy.

More specifically, the collapsible mobile work bench and tool support stand of the present invention has a work surface that remains horizontal regardless of the height of the work bench. The work bench can also act as a mount for a tool. Handles are attached to the work surface and include a trigger for controlling the height of the work surface at various positions between fully raised and collapsed. Between these positions, the height is infinitely adjustable.

The body of work surface has first and second arms journaled to the work surface that are rotatable between the collapsed position and the fully extended position. A control box contains at least a main and secondary shaft upon which the first and second arms are journaled. Support legs are journaled to the control box and in the disclosed embodiment are journaled upon the main shaft within the control box.

The trigger operatively engages the first and second arms to control the rotation of the arms between the collapsed positions and fully extended positions.

These and other features and advantages of this invention will become more apparent to those skilled in the art from the detailed description of a preferred embodiment. The drawings that accompany the detailed description are described below.

DETAILED DESCRIPTION OF THE DRAWINGS

Figure 1:
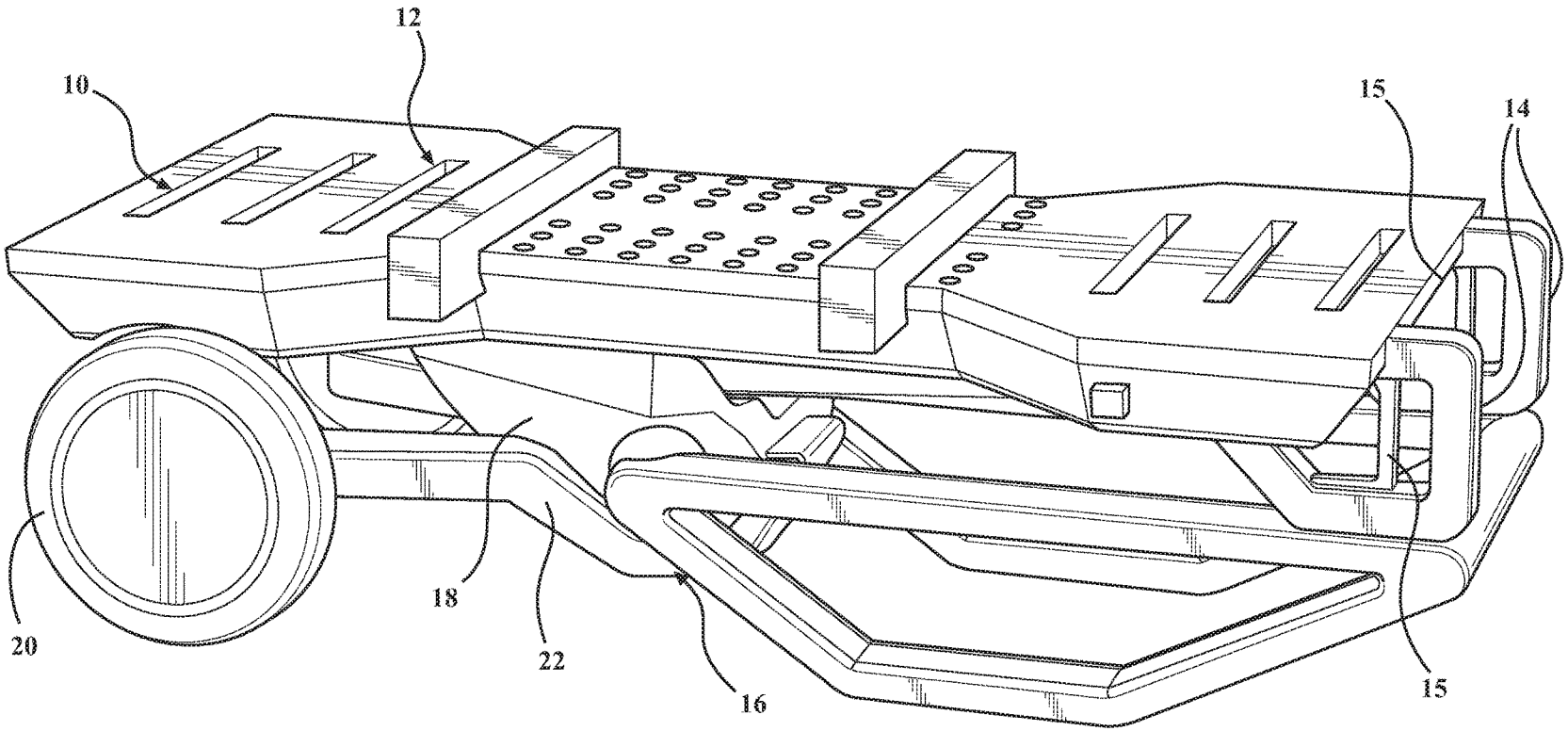
FIG. 1 is a perspective view of the collapsible mobile work bench and tool support stand of the present invention in the collapsed position.

The collapsible mobile workbench of the present invention is generally shown at 10 in FIG. 1. The workbench 10 has a single plane work surface 12 that allows the operator to use the workbench when a tool is not installed. The workbench 10 has handles 14 that allow the workbench to be moved upon wheels 20 and to allow the workbench to deploy the support frame 16 through control box 18.

These and other features and advantages of this invention will become more apparent to those skilled in the art from the detailed description of a preferred embodiment. The drawings that accompany the detailed description are described below.

Figure 2:
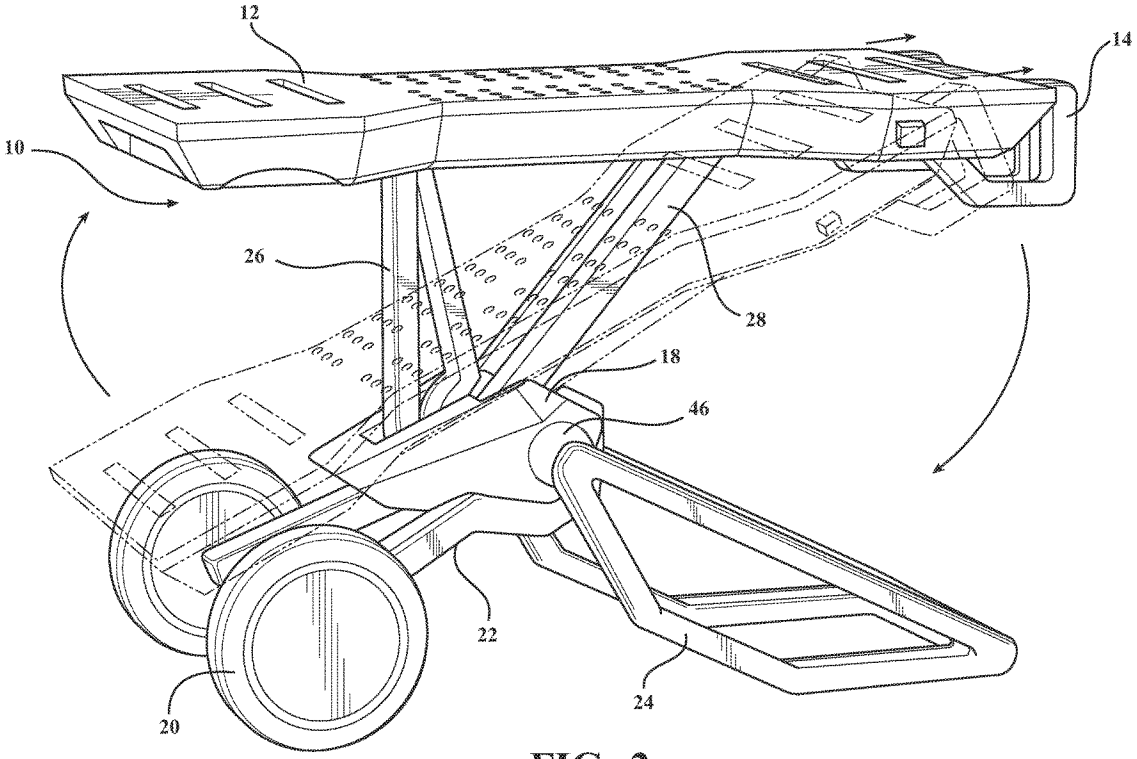
FIG. 2 is a perspective view of the collapsible mobile work bench and tool support stand of the present invention between the raised and collapsed position.

With reference to FIG. 2, the workbench 10 is illustrated between the collapsed position and the raised position. The handles 14 include triggers 15 to control the position of the work bench 10. In the first embodiment, the triggers 15 are squeezed to engage the control box 18. The control box 18 contains for example a gearbox that interconnects the members of the support frame 16 and allows it to rotate between the raised and collapsed positions. As illustrated, the members of the support frame 16 include wheel supports 22, and support legs 24. Support arms 26 and 28 extend from the control box 18 to the work surface 12. The arms 26 and 28 are journaled upon shafts in the control box 18 and mounted to the interior of the work surface 12. The work surface 12 can be raised to any desired level between collapsed and fully raised. The arms 26 and 28 are raised together to maintain the work surface 12 parallel at any desired height. Once the desired height is obtained, the triggers 15 are released to maintain that desired position.

Figure 4:
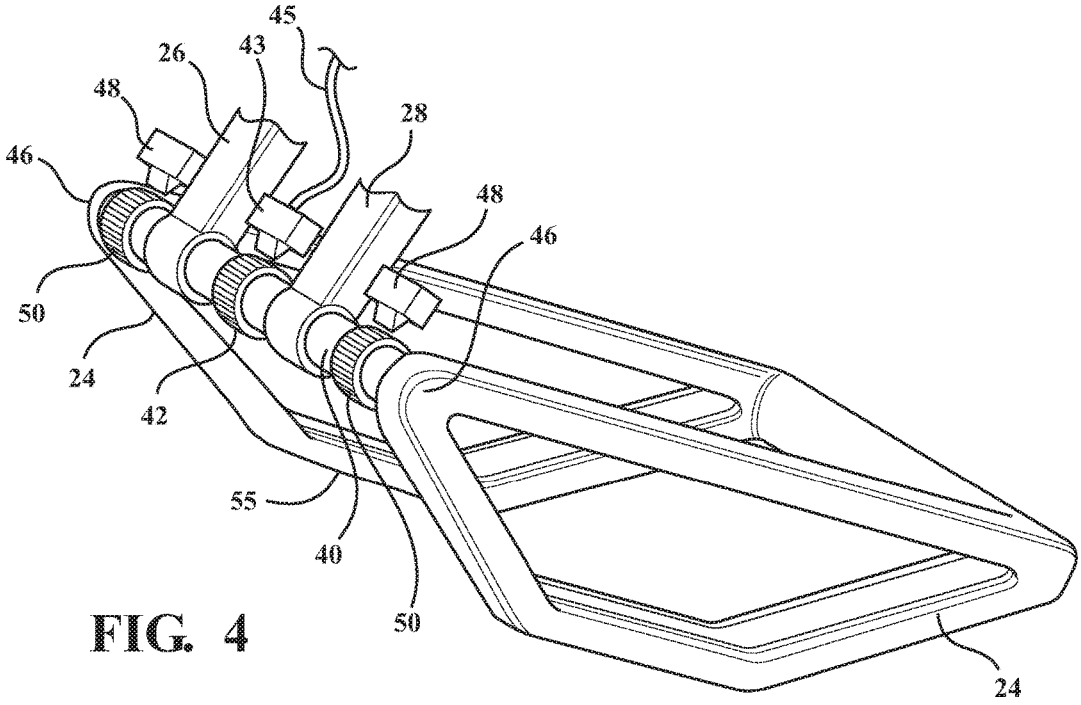
FIG. 4 is a schematic view of the control system of the present invention.

With reference to FIG. 4, a schematic of the interior of the control box 18 is illustrated. The control box 18 includes a main shaft 40 having a control gear 42 mounted upon the shaft 40. A locking finger 43 connected to the trigger 15 through a control wire 45 engages the gear 42 to lock the gear 42 in place or release the gear 42. The control wire 45 is snaked through the arms 26 and 28 in the disclosed embodiment. The control wire 45 connected to the trigger 15 can be engaged and disengaged to control the rotation of the shaft 40. The arms 28 are mounted to the shaft 40 and there position is determined by the position of the shaft 40. The shaft 40 is journaled in opposed bearings 46 mounted to the control box 18. Although not shown, the shaft 40 can be spring loaded to allow for automatic raising or collapsing with biased resistance in the opposite direction.

Mounted within the control box are pawls 48 which engage gears 50 mounted on the legs 24. The pawls 48 act as a ratchet to control the position of the legs 24. The legs 26 are mounted on shafts (not shown) within the control box 18 and are journaled upon these shafts. In the disclosed embodiment, the legs 26 freely rotate upon the shaft. The pawls 48 control the position of the legs 26.

To raise or lower the work bench 10, the trigger 15 connected to the control wire 45 when engaged releases the locking finger 43 allowing the shaft 40 to rotate. Rotation of shaft 40 causes support arms 28 to raise or lower to any desired position. The support arms 26 are journaled upon shafts (not shown) mounted within the control box 18 and are free to move in response to the movement of arms 28. In this way, the work surface 12 remains horizontal. When the desired height of the work surface 12 is obtained, the trigger 15 is released and the gear 42 is engaged by the locking finger 43. The support leg 24 is positioned by the operator stepping on the support leg connecting bar 55 and ratchetting the support legs gear 50 against the pawl 48.

Figure 5:
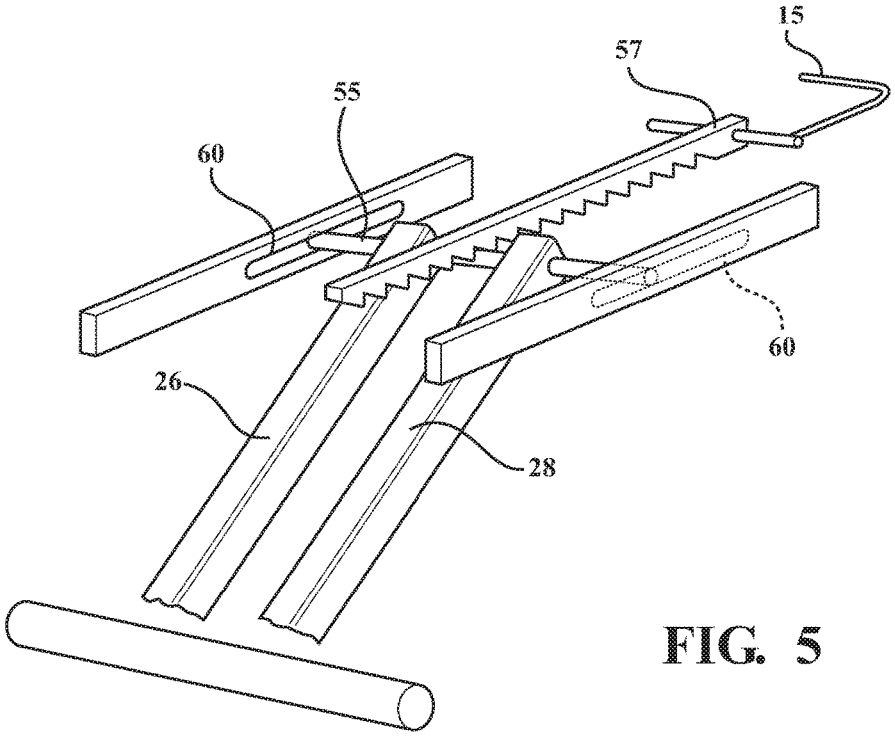
FIG. 5 is a schematic view of a second embodiment of the control system of the present invention.

With reference to FIG. 5, a second embodiment of the height control feature of the present invention is illustrated. In this embodiment, the arms 26 and 28 are journaled upon shaft 40 within the control box 18 and freely rotate about the shafts. The opposite ends of the arms 28 are journaled upon a rod 55 that is mounted within slots 60 formed in opposing interior sides of the workbench 10. A locking bar 57 is controlled by the trigger 15 in the handle 14. The trigger 15 can raise and lower the locking bar 57 to control the position of the arms 28 and as a result the position of the arms 26. In the preferred embodiment, the locking bar 57 is spring loaded into the locked position.

Figure 3:
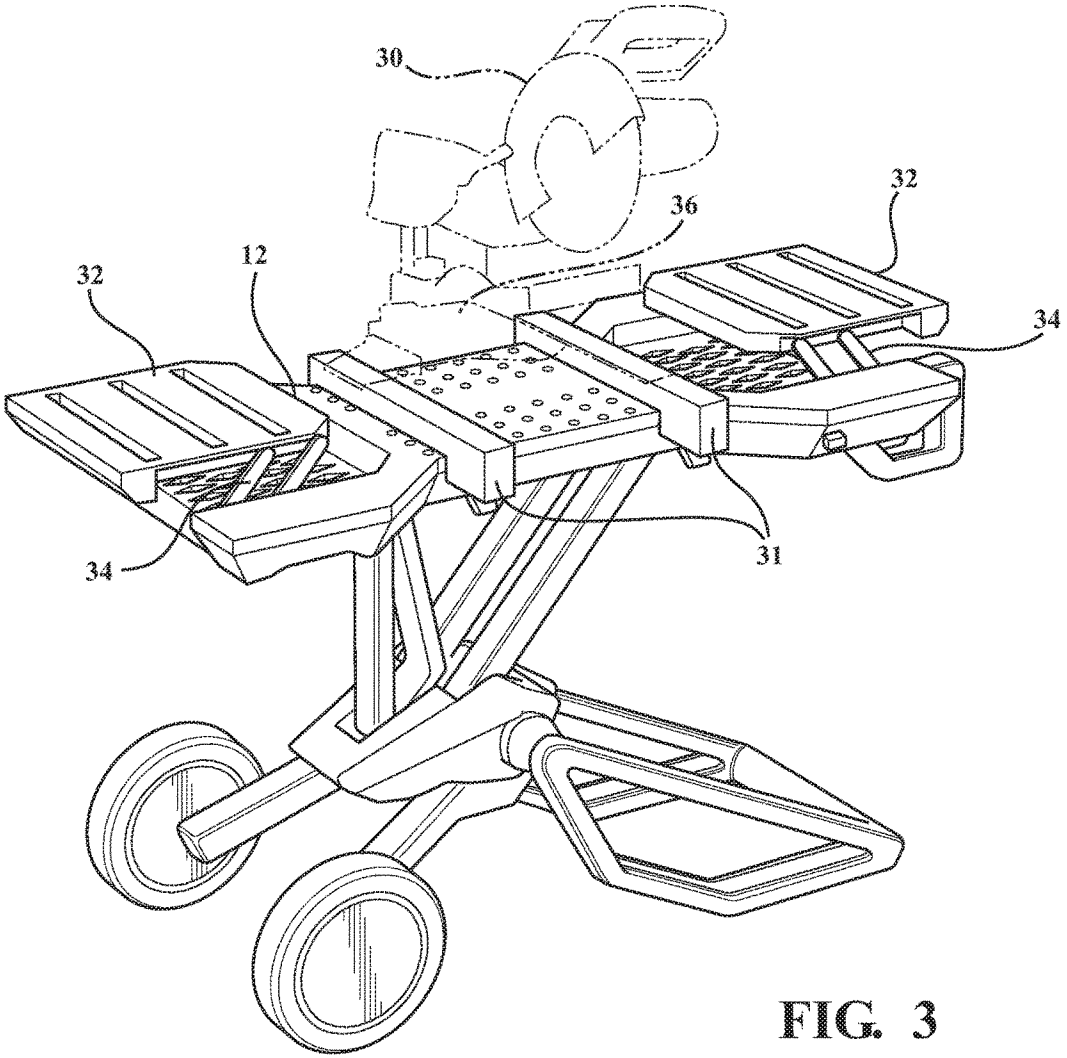
FIG. 3 is a perspective view of the collapsible mobile work bench and tool support stand of the present invention in the raised position with the movable platforms raised and illustrating the mounting of a tool.

With reference to FIG. 3, a tool 30 is shown mounted to the workbench 10. In the disclosed embodiment, the work surface 12 is generally shaped as an hourglass, with the opposed ends being wider than the middle. The middle is narrower to accommodate quick mounts 31 attached to a tool. Quick mounts 31 are used to quickly mount the tool to the work surface 12 of the workbench 10.

Each side of the work surface includes a moveable platform 32 that can be raised with respect to the work surface 12 through links 34. In the disclosed embodiment, the links 34 form a parallelogram so that the platform 32 moves upward and parallel to the work surface 12. The platform 32 can also slide with respect to the tool 30 mounted to the work surface 12. In this way, the platform 32 can be raised to the height of the tool base surface 36 of the tool mounted to the surface 12 and can be slid to adjacent the tool base surface 36. By allowing the surface 32 to be adjusted both vertically and horizontally with respect to the tool base surface 36, a continuous work surface can be formed between the two surfaces 32 and the tool base surface 36.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A collapsible mobile bench comprising:

a work surface;

handles attached to said work surface, said handles including a trigger for controlling the height of said work surface;

first and second arms journaled to said work surface, said arms being rotatable between a collapsed position and a fully extended position;

a control box containing at least a main and secondary shaft upon which said first and second arms are journaled;

support legs journaled upon said control box;

pawls mounted within said control box, and support leg gears mounted upon said support legs, said pawls engaging said gears to control the position of said support legs;

said trigger operatively engaging said first and second arms to control the rotation of said arms between said collapsed positions and fully extended positions.

2. The collapsible mobile bench of claim 1, further including a control gear mounted upon said main shaft;

a locking finger operatively connected to said trigger, said locking finger engages said control gear to selectively lock said gear in place;

said first arms mounted to said main shaft and there position being determined by the position of said shaft.

3. The collapsible mobile bench of claim 2, wherein said shaft is journaled in opposed bearings mounted to the control box.

4. The collapsible mobile bench of claim 2, further including a control wire interconnecting said trigger and said locking finger, said control wire connected through said handle and operative to be engaged and disengaged to control the rotation of said main shaft.

5. The collapsible mobile bench of claim 1, wherein said arms are journaled upon main and secondary shafts within said control box and freely rotate about said main and secondary shafts;

a rod mounted within slots in said work surface, a locking bar 57 controlled by said trigger in said handle, said trigger controlling the position of arms.

6. The collapsible mobile bench of claim 1, wherein each side of said work surface includes a moveable platform that can be raised with respect to the work surface.

7. The collapsible mobile bench of claim 6, wherein said moveable platform is mounted to said work surface through links.

8. The collapsible mobile bench of claim 7, wherein said links form a parallelogram so that the platform moves upward and parallel to work surface.

9. The collapsible mobile bench of claim 6, wherein said platform can slide with respect to said work surface, such that said platform can be raised to the height of a tool base surface of a tool mounted to said surface and can be slid to adjacent the tool base surface, thereby forming a continuous work surface between the two surfaces and the tool base surface.

10. The collapsible workbench of claim 1, further including wheels.

11. The collapsible workbench of claim 1, wherein said work surface has opposed ends and a middle section, said opposed ends being wider than said middle section, said middle section being adapted to receive a tool.

12. A collapsible mobile bench comprising:

a work surface;

said work surface having opposed ends and a middle section, said opposed ends being wider than said middle section, said middle section being adapted to receive a tool;

said work surface being adjustable between collapsed and raised positions, said work surface being positionable at infinite positions between said collapsed and raised positions;

a set of wheels mounted to said work surface for transportation of said work bench;

handles attached to said work surface, said handles including a trigger for controlling the height of said work surface;

first and second arms journaled to said work surface, said arms being rotatable between a collapsed position and a fully extended position;

a control box containing at least a main and secondary shaft upon which said first and second arms are journaled;

a control gear mounted upon said main shaft;

a locking finger operatively connected to said trigger, said locking finger engages said control gear to selectively lock said gear in place;

said first arms mounted to said main shaft and there position being determined by the position of said shaft;

support legs journaled upon said control box;

said trigger operatively engaging said first and second arms to control the rotation of said arms between said collapsed positions and fully extended positions;

a control gear mounted upon said main shaft;

a locking finger operatively connected to said trigger, said locking finger engages said control gear to selectively lock said gear in place;

said first arms mounted to said main shaft and there position being determined by the position of said shaft;

a control wire interconnecting said trigger and said locking finger, said control wire connected through said handle and operative to be engaged and disengaged to control the rotation of said main shaft;

whereby said work surface can be used as a work bench or a tool support and collapsed for transport and raised to a desired height for use.

13. The collapsible mobile bench of claim 12, wherein said shaft is journaled in opposed bearings mounted to the control box.

14. The collapsible mobile bench of claim 13, further including pawls mounted within said control box, and support leg gears mounted upon said support legs, said pawls engaging said gears to control the position of said support legs.

15. The collapsible mobile bench of claim 13, wherein said arms are journaled upon main and secondary shafts within said control box and freely rotate about said main and secondary shafts;

a rod mounted within slots in said work surface, a locking bar controlled by said trigger in said handle, said trigger controlling the position of arms.

16. The collapsible mobile bench of claim 12, wherein each side of said work surface includes a moveable platform that can be raised with respect to the work surface said moveable platform is mounted to said work surface through links, said links form a parallelogram so that the platform moves upward and parallel to work surface.

17. The collapsible mobile bench of claim 16, wherein said platform can slide with respect to said work surface, such that said platform can be raised to the height of a tool base surface of a tool mounted to said surface and can be slid to adjacent the tool base surface, thereby forming a continuous work surface between the two surfaces and the tool base surface.

18. A collapsible mobile bench comprising:

a work surface, each side of said work surface includes a moveable platform that can be raised with respect to the work surface;

handles attached to said work surface, said handles including a trigger for controlling the height of said work surface;

first and second arms journaled to said work surface, said arms being rotatable between a collapsed position and a fully extended position;

a control box containing at least a main and secondary shaft upon which said first and second arms are journaled;

support legs journaled upon said control box;

said trigger operatively engaging said first and second arms to control the rotation of said arms between said collapsed positions and fully extended positions.

19. The collapsible mobile bench of claim 18, further including a control gear mounted upon said main shaft;

a locking finger operatively connected to said trigger, said locking finger engages said control gear to selectively lock said gear in place;

said first arms mounted to said main shaft and there position being determined by the position of said shaft.

20. The collapsible mobile bench of claim 19, wherein said shaft is journaled in opposed bearings mounted to the control box.

21. The collapsible mobile bench of claim 18, further including pawls mounted within said control box, and support leg gears mounted upon said support legs, said pawls engaging said gears to control the position of said support legs.

22. The collapsible mobile bench of claim 19, further including a control wire interconnecting said trigger and said locking finger, said control wire connected through said handle and operative to be engaged and disengaged to control the rotation of said main shaft.

23. The collapsible mobile bench of claim 18, wherein said arms are journaled upon main and secondary shafts within said control box and freely rotate about said main and secondary shafts;

a rod mounted within slots in said work surface, a locking bar 57 controlled by said trigger in said handle, said trigger controlling the position of arms.

24. The collapsible mobile bench of claim 18, wherein said moveable platform is mounted to said work surface through links.

25. The collapsible mobile bench of claim 24, wherein said links form a parallelogram so that the platform moves upward and parallel to work surface.

26. The collapsible mobile bench of claim 18, wherein said platform can slide with respect to said work surface, such that said platform can be raised to the height of a tool base surface of a tool mounted to said surface and can be slid to adjacent the tool base surface, thereby forming a continuous work surface between the two surfaces and the tool base surface.

27. The collapsible workbench of claim 18, further including wheels.

28. The collapsible workbench of claim 18, wherein said work surface has opposed ends and a middle section, said opposed ends being wider than said middle section, said middle section being adapted to receive a tool.

* * * * *